US008979011B2

(12) United States Patent
Tsai

(10) Patent No.: US 8,979,011 B2
(45) **Date of Patent: *Mar. 17, 2015**

(54) METHOD AND STRUCTURE FOR SEPARATING THE WEB MATERIAL IN A WINDING MACHINE

(75) Inventor: Tung-I Tsai, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 671 days.

This patent is subject to a terminal disclaimer.

(21) Appl. No.: 13/222,058

(22) Filed: Aug. 31, 2011

(65) Prior Publication Data

US 2011/0309184 A1 Dec. 22, 2011

Related U.S. Application Data

(63) Continuation-in-part of application No. 11/902,812, filed on Sep. 26, 2007, now Pat. No. 8,220,736.

(30) Foreign Application Priority Data

Jul. 27, 2007 (TW) ..... 96127668 A

(51) Int. Cl.
*B65H 19/28* (2006.01)
*B65H 19/29* (2006.01)
*B65H 35/08* (2006.01)
(Continued)

(52) U.S. Cl.
CPC ..... *B65H 19/267* (2013.01); *B65H 19/2269* (2013.01); *B65H 2301/41425* (2013.01); *B65H 2301/41812* (2013.01); *B65H 2406/33* (2013.01)
USPC ..... 242/521; 242/526.1; 242/532.2; 242/542.1

(58) Field of Classification Search
CPC ..... B65H 19/267; B65H 20/26
USPC ..... 242/521, 526.1, 532.2, 533.1, 542, 242/542.1, 542.2, 542.3; 168/283
IPC ..... B65H 19/24, 19/26, 19/28, 18/16, 18/18
See application file for complete search history.

(56) References Cited

U.S. PATENT DOCUMENTS 5,092,533 A * 3/1992 Gangemi ..... 242/521
6,595,458 B1 * 7/2003 Biagiotti ..... 242/532.2
(Continued)

FOREIGN PATENT DOCUMENTS

JP 03158350 A * 7/1991 ..... B65H 19/26
WO WO 2005075328 A1 * 8/2005 ..... B65H 19/22

*Primary Examiner* — William A Rivera
*Assistant Examiner* — Stefan Kruer
(74) *Attorney, Agent, or Firm* — Rosen, Klein & Lee

(57) ABSTRACT

A winding machine includes an upper winding roller and a separation mechanism arranged at a location close to and below the upper winding roller. The separation mechanism includes a pivot shaft having an outer circumferential surface and at least one pinch arm having a connecting end coupled to the outer circumferential surface of the pivot shaft and a web engagement end extending outward from the outer circumferential surface of the pivot shaft. When the pinch arm is driven by a driving mechanism to rotate the web engagement end of the pinch arm to an engagement position where the web engagement end opposes the upper winding roller, the web engagement end of the pinch arm sucks and holds or guides a web material passing therethrough, whereby the web material is subjected to a pulling force induced by a roll of paper formed in a winding nip to tear and thus separate.

4 Claims, 12 Drawing Sheets

(51) Int. Cl.
*B65H 19/26* (2006.01)
*B65H 19/22* (2006.01)

(56) References Cited

U.S. PATENT DOCUMENTS 6,948,677 B2 * 9/2005 Biagiotti et al. ..... 242/521
7,172,151 B2 * 2/2007 Biagiotti et al. ..... 242/521
8,100,357 B2 * 1/2012 Tsai ..... 242/532.2
2004/0061021 A1 * 4/2004 Butterworth ..... 242/521
2004/0256513 A1 * 12/2004 Perini ..... 242/521
2005/0279875 A1 * 12/2005 Biagiotti et al. ..... 242/533
2006/0011767 A1 * 1/2006 Biagiotti et al. ..... 242/526
2007/0095967 A1 * 5/2007 Biagiotti et al. ..... 242/526
2007/0262512 A1 * 11/2007 Watanabe et al. ..... 271/11
2008/0224383 A1 * 9/2008 Feygelman ..... 271/161
2009/0095836 A1 * 4/2009 Maddaleni et al. ..... 242/526
2010/0101185 A1 * 4/2010 Maddaleni et al. ..... 53/430
2010/0258670 A1 * 10/2010 Tsai ..... 242/526
2014/0054407 A1 * 2/2014 Mazzaccherini et al. ..... 242/522

* cited by examiner

METHOD AND STRUCTURE FOR SEPARATING THE WEB MATERIAL IN A WINDING MACHINE

CROSS-REFERENCES TO RELATED APPLICATIONS

This application is a continuation-in-part of Ser. No. 11/902,812 filed on Sep. 26, 2007, entitled "WEB SEPARATOR WITH REVERSE ROTATION MECHANISM FOR TISSUE PAPER WINDING MACHINE", currently pending.

FIELD OF THE INVENTION

The present invention relates to tearing and thus separating a web material, and in particular to a method and a structure for separating the web material in a winding machine

BACKGROUND OF THE INVENTION

A conventional winding machine comprises an upper winding roller, a guide plate, a lower winding roller, and a rider roller. The guide plate is arranged at a location close to and below a circumferential surface of the upper winding roller and forms a channel with the upper winding roller. The upper winding roller, the lower winding roller, and the rider roller form therebetween a winding nip.

A core around which a web material is wound to form a roll of paper is fed by a conveyor to a location beside the upper winding roller and is then pushed by a core inserter into a passage delimited by the guide plate to reach the winding nip where the web material is wound around the core to form the roll of paper, such as a roll of toilet tissue. After completion of the winding operation of a roll of paper, a rotatable arm is controlled to have a speed that is faster or slower than the rotational speed of the upper winding roller in order to induce a speed difference by which the web material is torn and thus separated.

Another known technique uses a method and a structure that realizes separation of web material with physical engagement. For example, a driving arm is positioned against a surface of an upper winding roller arranged in a winding machine to hold down a web material passing through the surface of the upper winding roller. The web material is then torn and thus separated by a pulling force induced by a roll of paper that is formed in a winding nip by wounding the paper around a core.

SUMMARY OF THE INVENTION

However, in the above discussed conventional winding machine, care must be taken for the rotatable arm to rotate at a speed not equal to that of an upper winding roller in order to pull apart the web material through a difference in speed. In case the web material is made of a tough material, the speed difference between the rotatable arm and the upper winding roller must be sufficiently large, otherwise the web material would not be pulled apart by the speed difference.

In the known web material separation technique that employs physical engagement, the driving arm must be positioned to physically contact the surface of the upper winding roller. This causes certain concerns about the durability and operation safety of the components and parts of the machine.

Thus, an objective of the present invention is to provide a winding machine comprising a separation mechanism that tears up and separates a web material with a non-physical-engagement type operation.

Another objective of the present invention is to provide a winding machine that comprises an evacuation device and a separation mechanism comprising a suction channel and a passage.

A further objective of the present invention is to provide a method and a device for separating the web material in a winding machine that employ a vacuum suction force to separate the web material.

The solution adopted in the present invention to overcome the problems of the conventional techniques comprises a winding machine that comprises an upper winding roller and a separation mechanism arranged at a location close to and below a circumferential surface of the upper winding roller. The separation mechanism comprises a pivot shaft having an outer circumferential surface and at least one pinch arm having a connecting end and a web engagement end. The connecting end is coupled to the outer circumferential surface of the pivot shaft. The web engagement end extends outward from the outer circumferential surface of the pivot shaft. When the pinch arm is driven by a driving mechanism to rotate the web engagement end of the pinch arm to an engagement position where the web engagement end opposes the upper winding roller, the web engagement end of the pinch arm sucks and holds or guides a web material passing therethrough, whereby the web material is subjected to a pulling force induced by a roll of paper formed in a winding nip to tear and thus separate.

With the solution provided by the present invention, the pinch arm is allowed to tear a web material fed through a winding machine without physical contact with an upper winding roller of the machine. Thus, smoothness and safety of the operation of the winding machine are enhanced and mechanical durability of the components and parts of the winding machine is improved.

BRIEF DESCRIPTION OF THE DRAWINGS

The present invention will be apparent to those skilled in the art by reading the following description of preferred embodiments of the present invention and the best modes for carrying out the present invention, with reference to the attached drawings, in which.

DETAILED DESCRIPTION OF THE PREFERRED EMBODIMENTS

Figure 1:
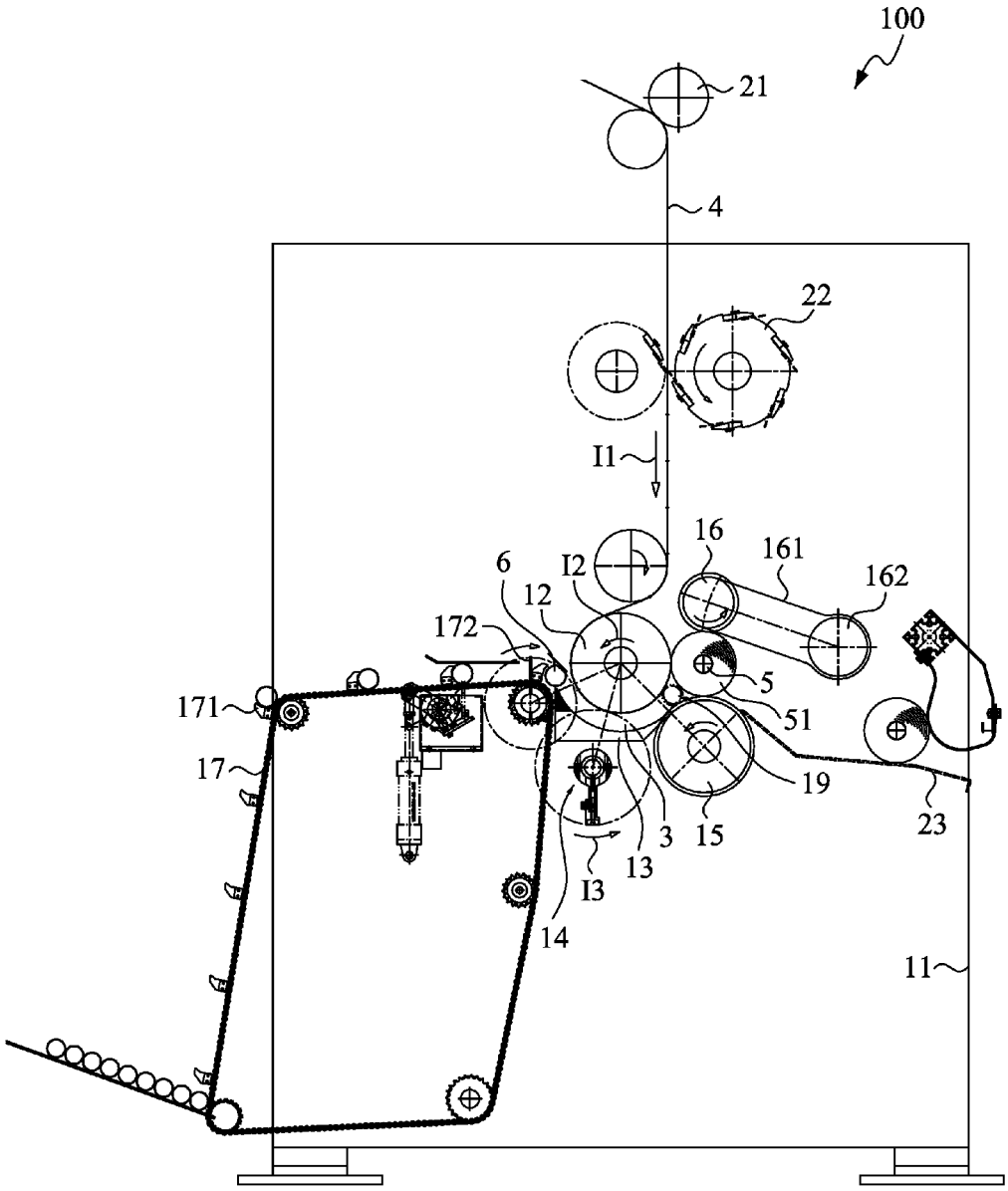
FIG. 1 is a schematic side elevational view showing a winding machine in accordance with a first embodiment of the present invention.

With reference to the drawings and in particular to FIG. 1, a winding machine constructed in accordance with a first embodiment of the present invention, broadly designated at 100, comprises a machine frame 11, an upper winding roller 12, a plurality of guide plates 13 (only one being visible in a schematic side elevational view shown in FIG. 1), a separation mechanism 14, a lower winding roller 15, a rider roller 16, a core conveyor 17, a pair of feed rollers 21, a perforation device 22, an inclined chute 23.

Figure 2:
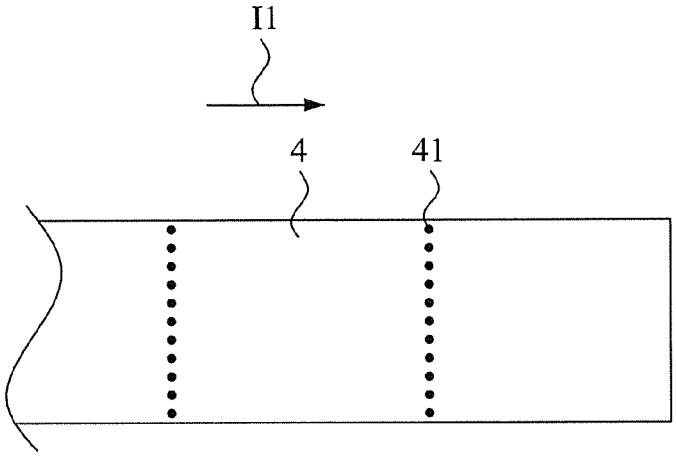
FIG. 2 is a schematic view showing formation of lines of perforations in a web material at a fixed interval according to the present invention.

The guide plates 13 are located at positions near and below the upper winding roller 12 such that a channel 3 is formed between the guide plates 13 and the upper winding roller 12. A winding nip 19 is formed between the upper winding roller 12, the lower winding roller 15, and the rider roller 16. A long tape of web material 4 that has a predetermined thickness and width is fed along a feeding direction I1 by the feed rollers 21 to pass through the perforation device 22 that forms a line of perforations 41 that extends in a direction substantially normal to the feeding direction I1 at a fixed interval (see FIG. 2). The web material tape is then moved to bear against a lower circumferential surface of the upper winding roller 12 and wound around a first core 5 at the winding nip 19 to thereby form a roll of paper 51 having a predetermined diameter, such as a roll of toilet paper.

Figure 3:
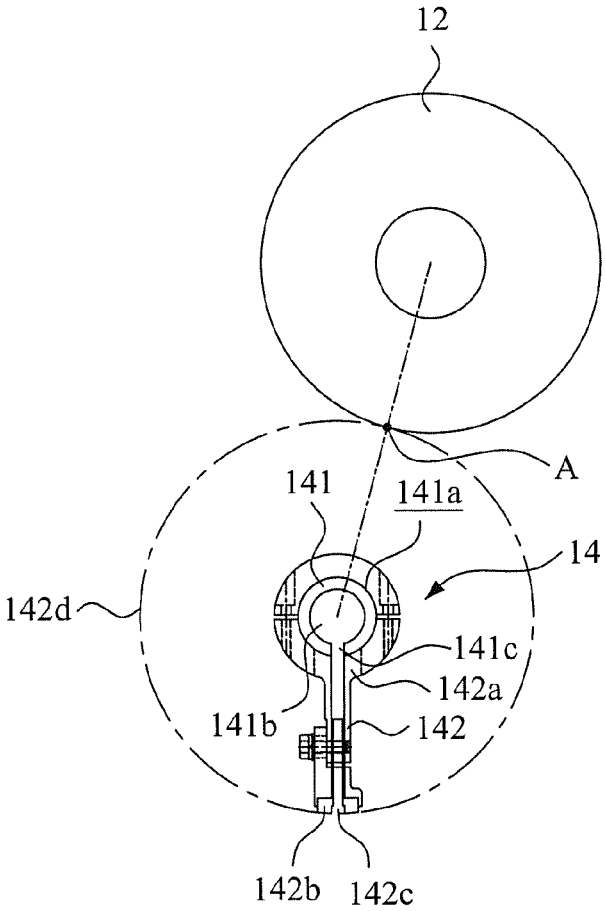
FIG. 3 is a schematic side view showing an upper winding roller and a pinch arm of a separation mechanism of the winding machine in accordance with the present invention.

Referring to FIG. 3, the separation device 14 is arranged near and below the upper winding roller 12. The separation device 14 comprises a pivot shaft 141 and at least one pinch arm 142. The pivot shaft 14 comprises an outer circumferential surface 141*a* and the pinch arm 142 is coupled to the outer circumferential surface 141*a* of the pivot shaft 141. Each pinch arm 142 has a connecting end 142*a* and a web engagement end 142*b*. The connecting end 142*a* is fixedly mounted to the outer circumferential surface 141*a* of the pivot shaft 141, and the web engagement end 142*b* extends outward from the outer circumferential surface 141*a* of the pivot shaft 141.

A driving mechanism (not shown) drives the pinch arm 142 to rotate about the pivot shaft 141. The pinch arm 142 is rotatable in a rotation direction 13 that is opposite to a rotation direction 12 of the upper winding roller 12 so that the web engagement end 142*b* of the pinch arm 142 is rotated to be selectively set on an engagement position A or off the engagement position A. The rotation of the pinch arm 142 defines a circular rotation locus 142*d*.

Figure 4:
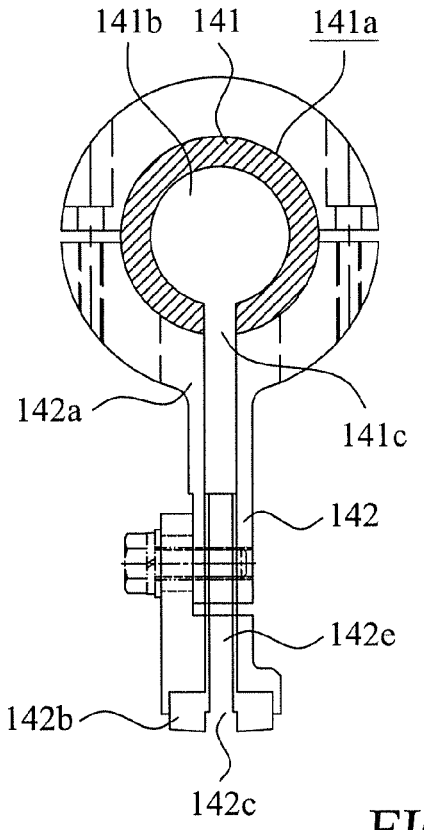
FIG. 4 is a cross-sectional view showing the separation mechanism according to the present invention.
Figure 5:
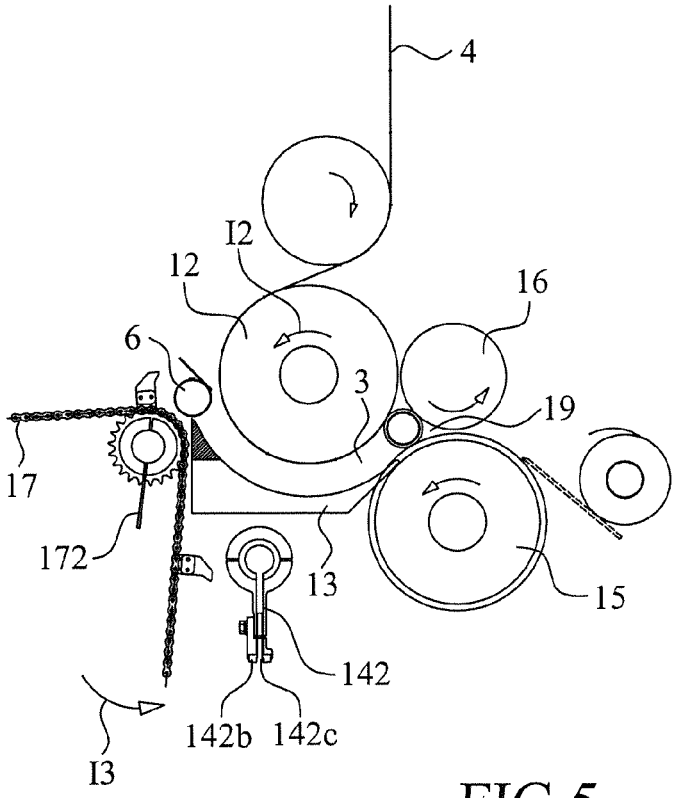
FIG. 5 is a schematic side view showing a first view of separating the web material by the winding machine according to the first embodiment of the present invention.

Also referring to FIG. 4, the web engagement end 142*b* of the pinch arm 142 forms a suction opening 142*c*. The pivot shaft 141 is a hollow tube forming internally a suction channel 141*b*. The pivot shaft 141 forms a plurality of apertures 141*c* in the outer circumferential surface 141*a* at predetermined positions to communicate the suction channel 141*b*. The pinch arm 142 forms internally at least one passage 142*e* communicating the suction opening 142*c* and the aperture 141*c* of the pivot shaft 141. An evacuation device (not shown) is connected to the pivot shaft 141 to remove air from the suction channel 141*b* of the pivot shaft 141 and the passage 142*e* of the pinch arm 142, so that the web engagement end 142*b* of the pinch arm 142 may establish a vacuum suction force at the suction opening 142*c*. Preferably, the suction opening 142*c* of the web engagement end 142*b* shows a recessed structure so that an excellent suction effect can be realized by the suction opening 142*c* to attract and hold the web material 4.

Figure 6:
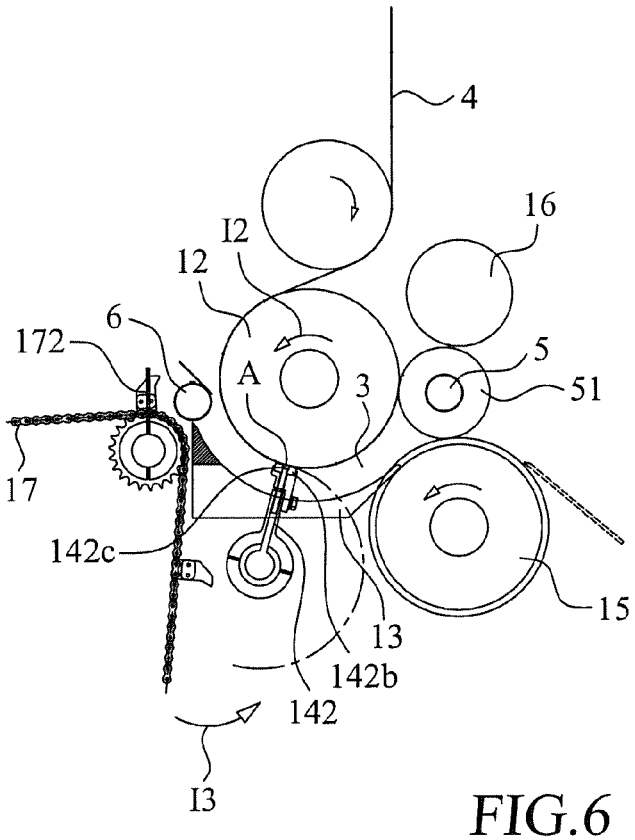
FIG. 6 is a schematic side view showing a second view of separating the web material by the winding machine according to the first embodiment of the present invention.
Figure 21:
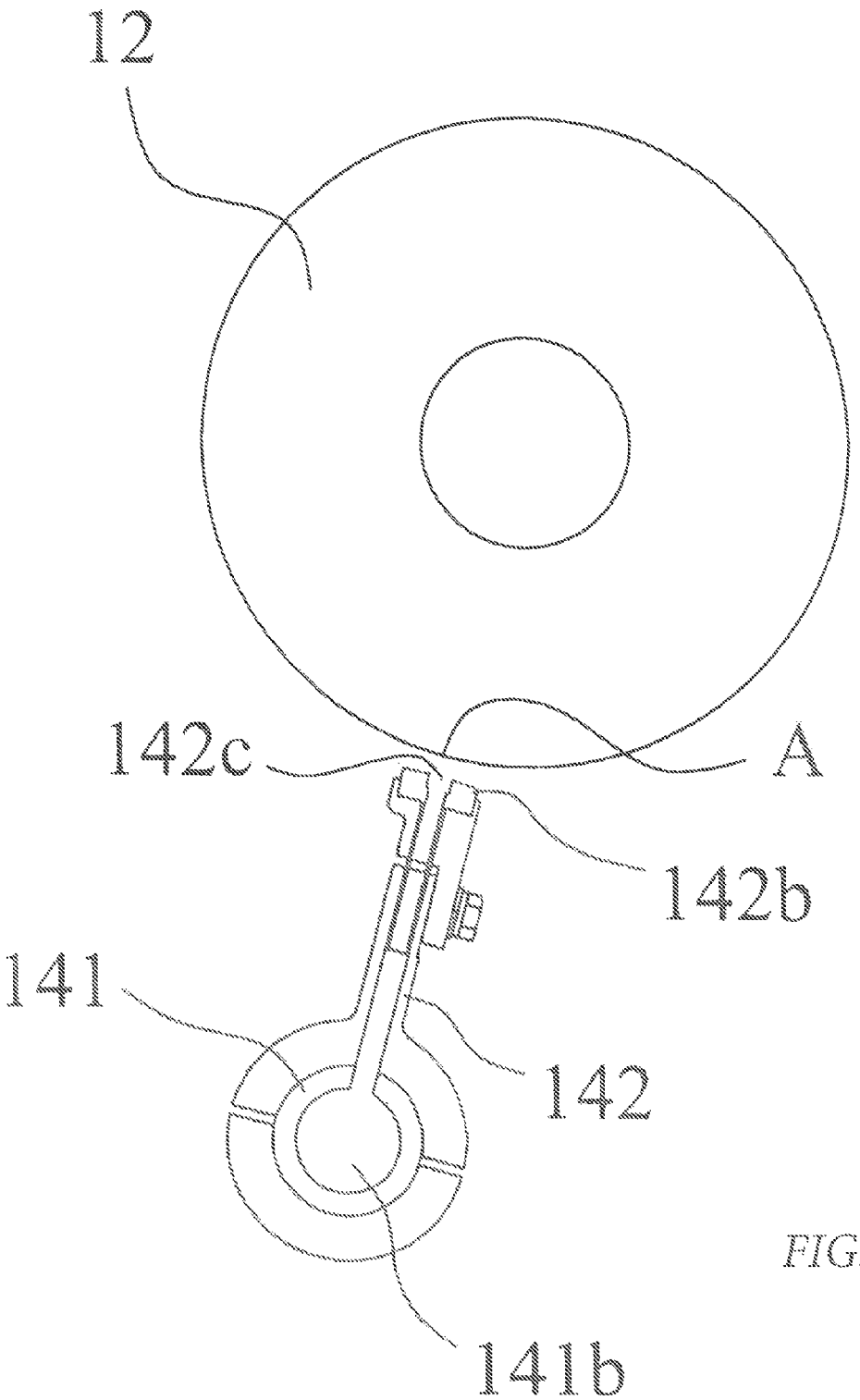
FIG. 21 is a schematic side view showing in enlarged form relevant portions the broader views shown of FIGS. 6 and 14.

Referring to FIGS. 5-12, a sequence of operations are performed by the winding machine according to the first embodiment of the present invention to tear and thus separate the web material. When the pinch arm 142 is driven to rotate along the rotation direction 13, the web engagement end 142*b* of the pinch arm 142 is periodically rotated to reach the engagement position A where the web engagement end 142*b* of the pinch arm 142 opposes the upper winding roller 12 (as shown in FIG. 6). At this moment, the web engagement end 142*b* of the pinch arm 142 is put into engagement with the web material 4, but maintains a predetermined spacing from the upper winding roller 12 and is thus not in physical engagement with the upper winding roller 12 (as shown in FIG. 21). The web engagement end 142*b* of the pinch arm 142 sucks and holds the web material 4 on the suction opening 142*c* of the pinch arm 142.

A second core 6 is carried forward by one of a number of carriers 171 of the core conveyor 17 to a loading nip of the channel 3 formed between the guide plates 13 and the upper winding roller 12. Afterwards, a core inserter 172 of the core conveyor 17 is automatically turned to push the second core 6 into the channel 3 (as shown in FIG. 7).

Figure 7:
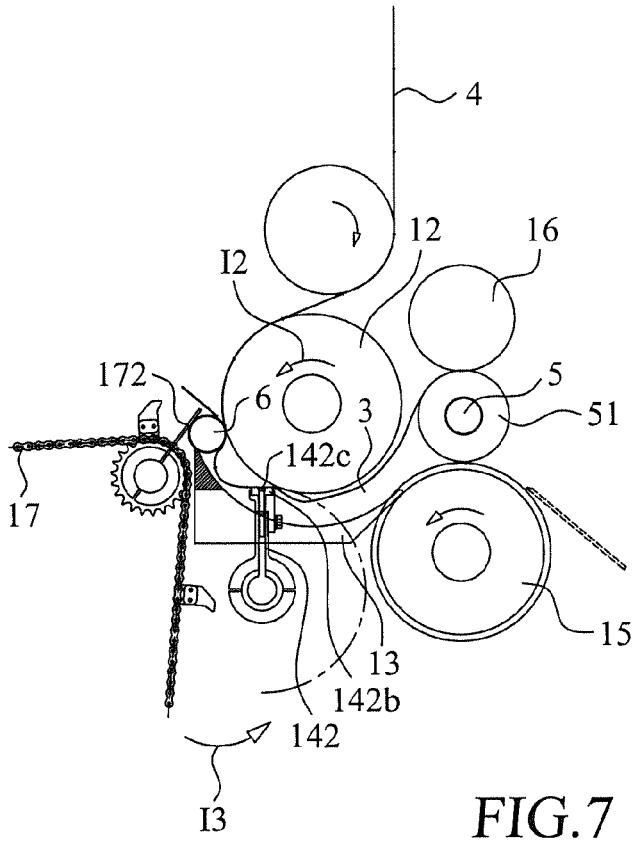
FIG. 7 is a schematic side view showing a third view of separating the web material by the winding machine according to the first embodiment of the present invention.
Figure 8:
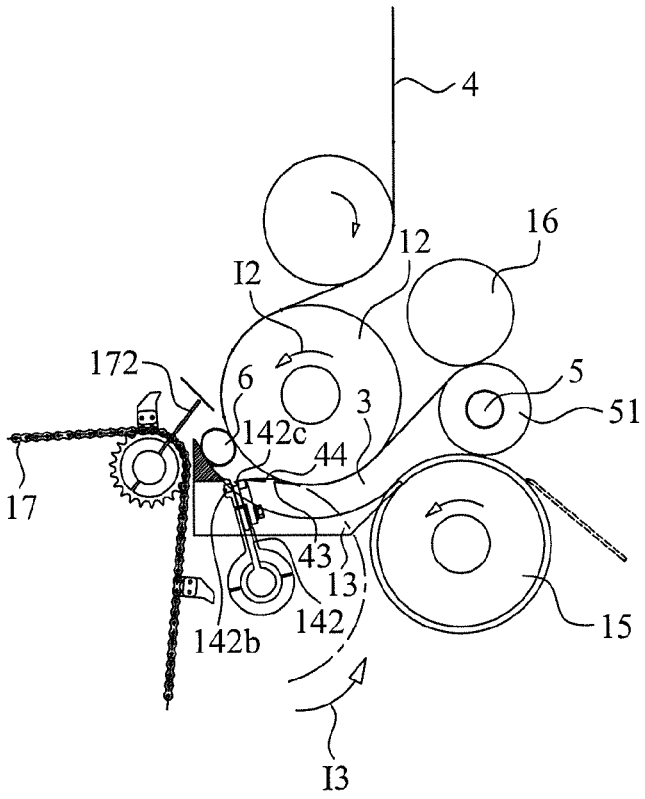
FIG. 8 is a schematic side view showing a fourth view of separating the web material by the winding machine according to the first embodiment of the present invention.
Figure 9:
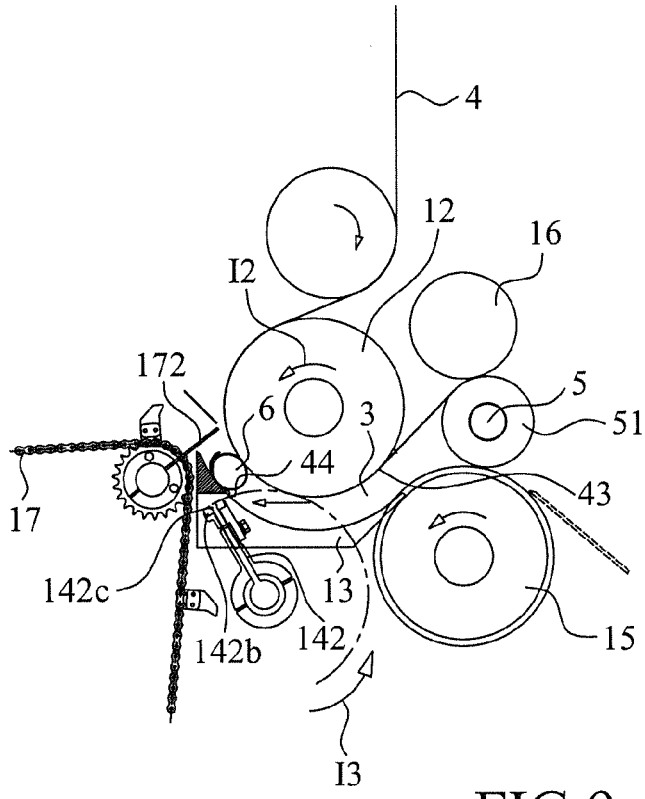
FIG. 9 is a schematic side view showing a fifth view of separating the web material by the winding machine according to the first embodiment of the present invention.

In a preferred embodiment of the present invention, to allow the web engagement end 142*b* of the pinch arm 142 to properly attract and hold the web material 4 passing through the channel 3, the rotational speed of the lower winding roller 15 is controlled by a controller (not shown) to reduce and get slightly slowed down at the time when the web engagement end 142*b* of the pinch arm 142 reaches the engagement position A, whereby the web material 4 gets partially slackened and hangs down (as shown in FIG. 7) to allow the web engagement end 142*b* of the pinch arm 142 to properly attract and hold the web material 4.

When the web material 4 is sucked and held by the web engagement end 142*b* of the pinch arm 142, the paper roll 51 that is formed by being rolled up in the winding nip 19 applies a pulling force to a right-hand side portion of the web material 4 so as to tear the web material 4, whereby the web material 4 that is so torn forms, at the location where the tearing occurs, a trailing edge 43 in connection with the first core 5 and a leading edge 44 in connection with the second core 6. The trailing edge 43 of the web material 4 keeps moving to and is then wound around the first core 5 to complete the winding operation of the paper roll 51 (see FIG. 10). At this point, the lower winding roller 15 resumes the original rotational speed. The location where the web material 4 is torn is between the engagement position A and the paper roll 51 of the first core 5. In a practical application, the location where the web material 4 tears is at the portion of the web material 4 where the perforations 41 are formed by the perforation device 22.

When the web material 4 is torn, the web engagement end 142*b* of the pinch arm 142 sucks and holds the leading edge 44 of the web material 4 and the pinch arm 142 is caused to rotate in an opposite direction to bring the leading edge 44 of the web material 4 to the second core 6 that is just fed into the channel 3, to allow the leading edge 44 of the web material 4 to be primarily wound around an outer circumferential surface of the second core 6.

Figure 10:
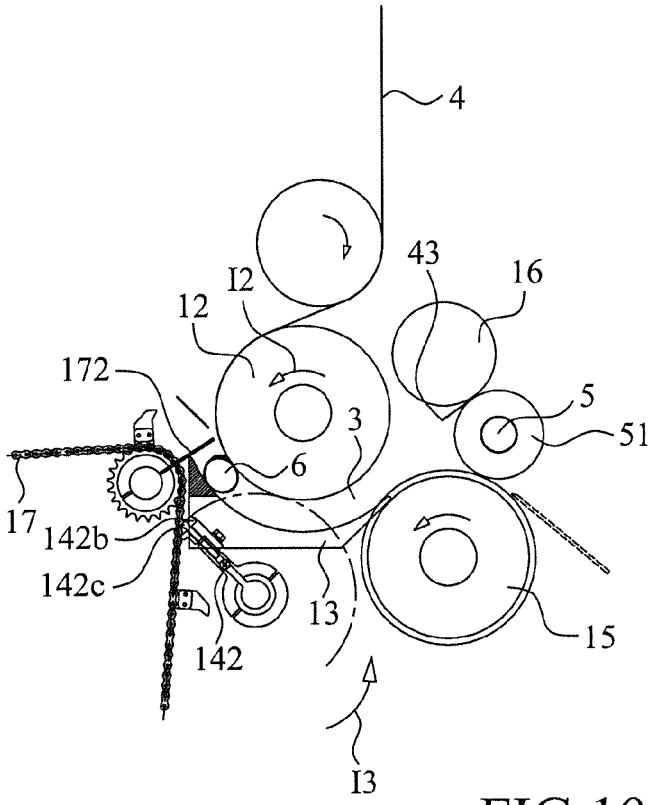
FIG. 10 is a schematic side view showing a sixth view of separating the web material by the winding machine according to the first embodiment of the present invention.

When the pinch arm 142 is rotated to such an extent to get away from the web material 4 and the channel 3, the second core 6 keeps rolling forward along the channel 3, and the leading edge 44 of the web material 4 is completely wound around the second core 6. Meanwhile, the trailing edge 43 of the web material 4 is attached to the paper roll 51 to complete the winding operation of the roll paper 51 (as shown in FIGS. 10 and 11).

Figure 11:
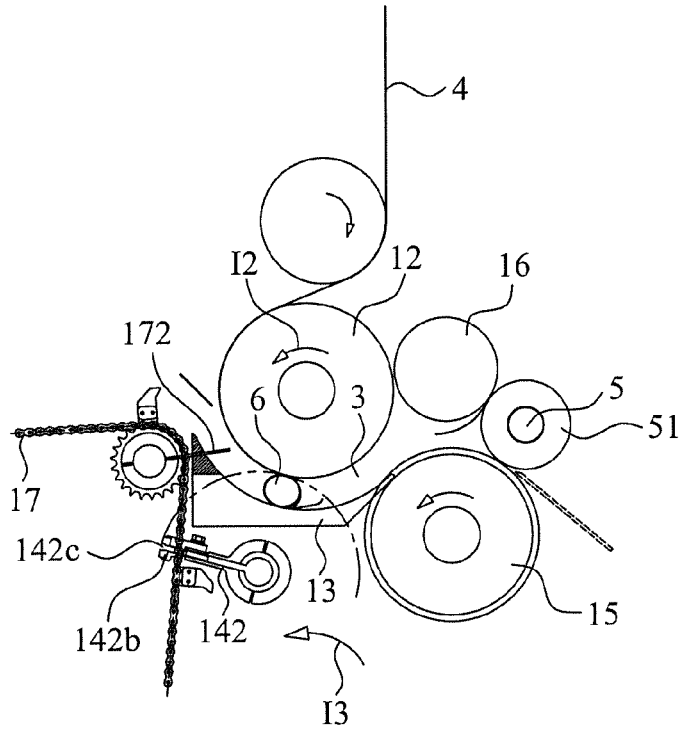
FIG. 11 is a schematic side view showing a seventh view of separating the web material by the winding machine according to the first embodiment of the present invention.
Figure 12:
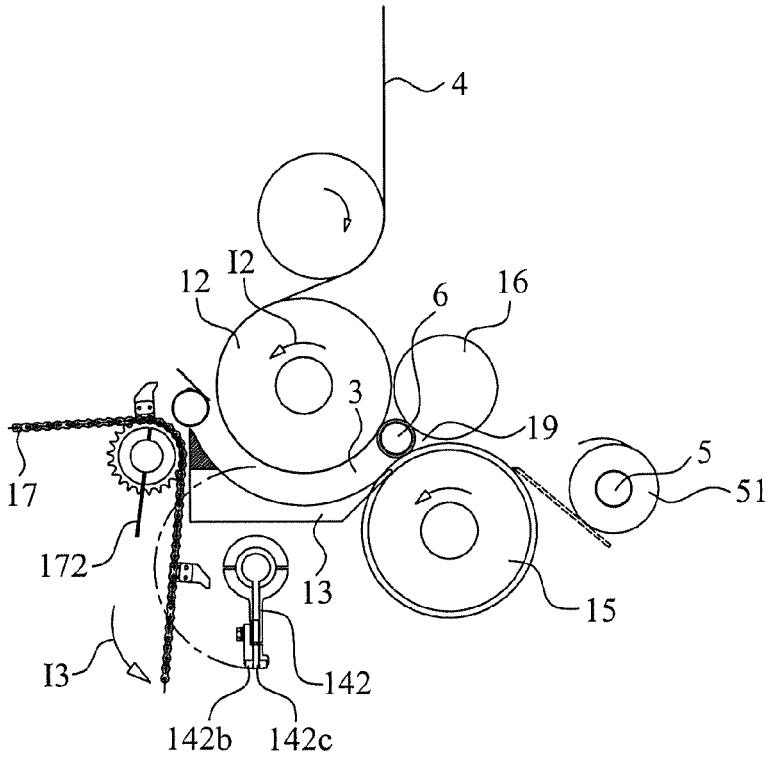
FIG. 12 is a schematic side view showing an eighth view of separating the web material by the winding machine according to the first embodiment of the present invention.

Referring to FIGS. 11 and 12, the second core 6 is transferred to the winding nip 19 due to an effect of speed difference between the upper winding roller 12 and the lower winding roller 15 caused by speed reduction of the lower winding roller 15 (see FIG. 12) and the winding operation of a new roll of paper starts. Meanwhile, the completed paper roll 51 is discharged by moving along the inclined chute 23.

When the paper roll 51 is being discharged, the rider roller 16 that is connected to a oscillable gripping arm 161 (see FIG. 1) having a pivot shaft 162 about which the oscillable gripping arm 161 reciprocally rotates is allowed to do reciprocal rotation about the pivot shaft 162, whereby the rider roller 16 that is connected to the oscillable gripping arm 161 is moved upward and downward, following the reciprocation path of the oscillable gripping arm 161. Thus, when the paper roll 51 has been discharged, the rider roller 16 that initially presses against the paper roll 51 moves downward to press against the second core 6.

Figure 13:
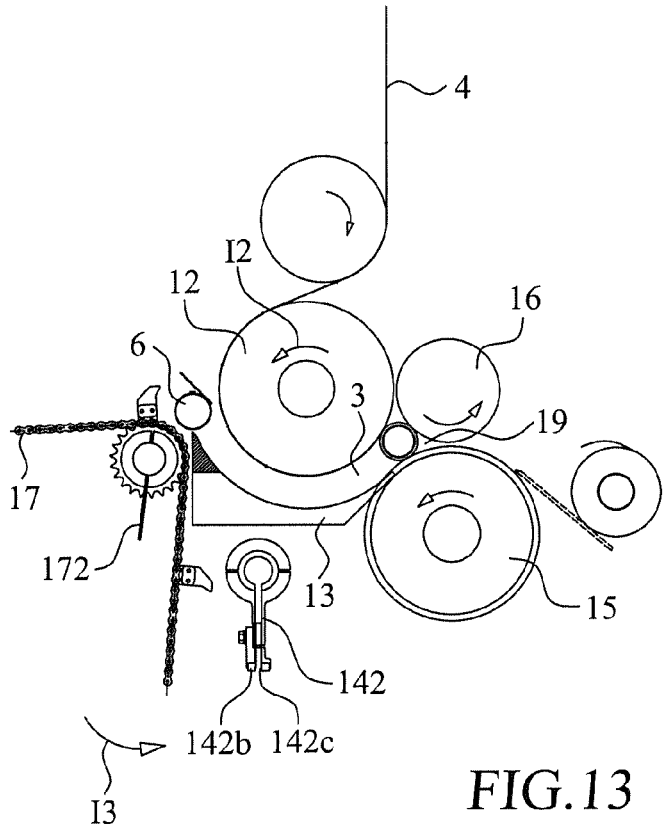
FIG. 13 is a schematic side view showing a first view of separating the web material by the winding machine according to a second embodiment of the present invention.
Figure 14:
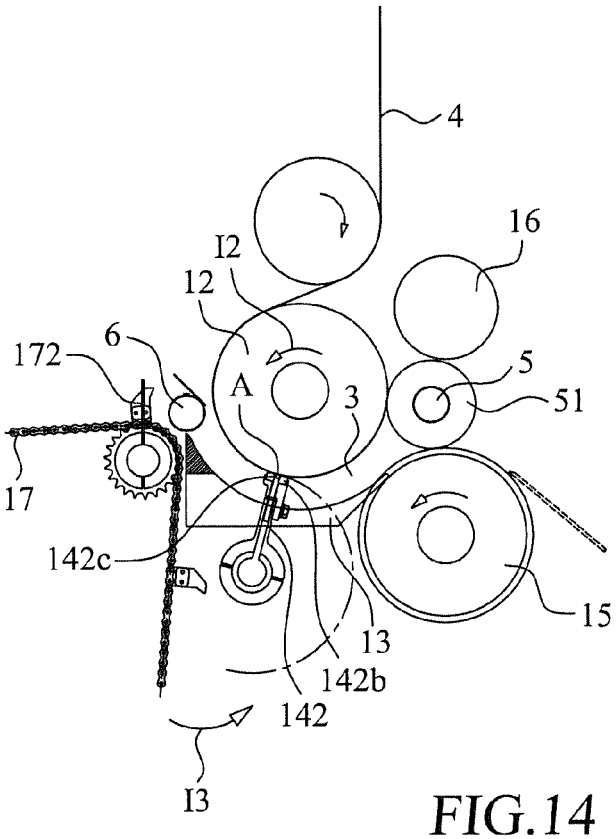
FIG. 14 is a schematic side view showing a second view of separating the web material by the winding machine according to the second embodiment of the present invention.
Figure 15:
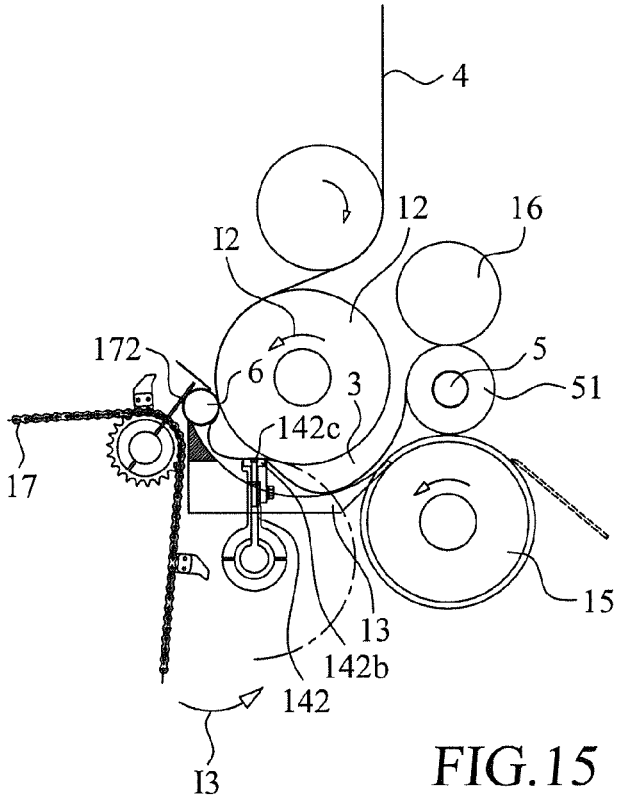
FIG. 15 is a schematic side view showing a third view of separating the web material by the winding machine according to the second embodiment of the present invention.
Figure 16:
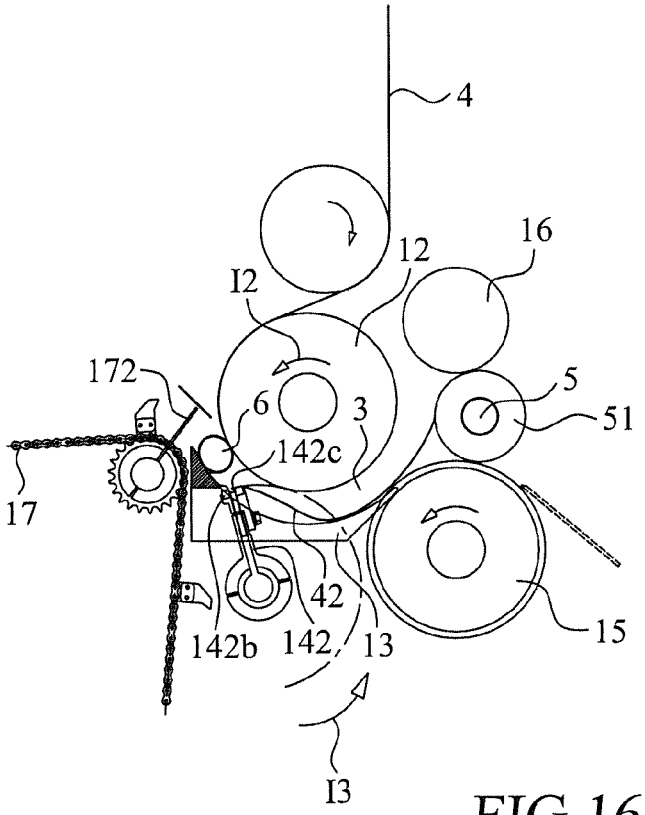
FIG. 16 is a schematic side view showing a fourth view of separating the web material by the winding machine according to the second embodiment of the present invention.
Figure 17:
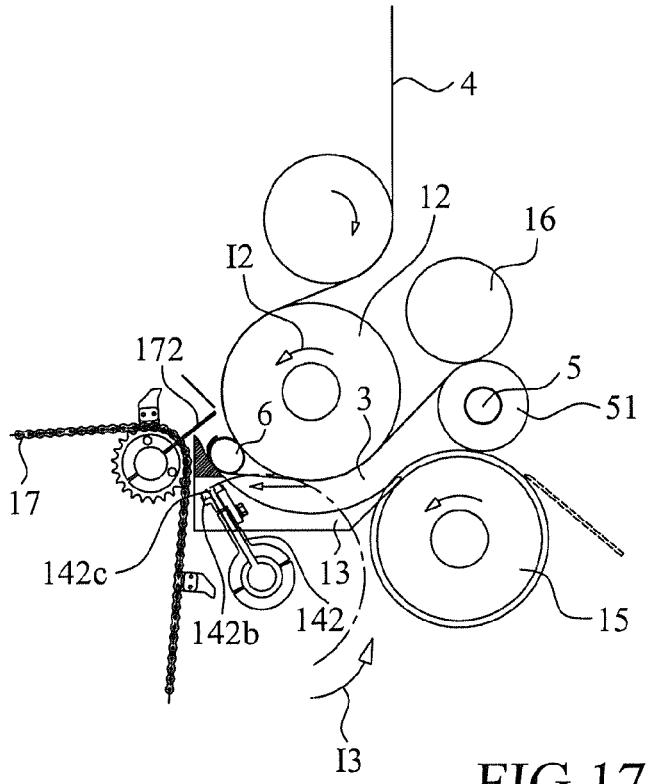
FIG. 17 is a schematic side view showing a fifth view of separating the web material by the winding machine according to the second embodiment of the present invention.
Figure 18:
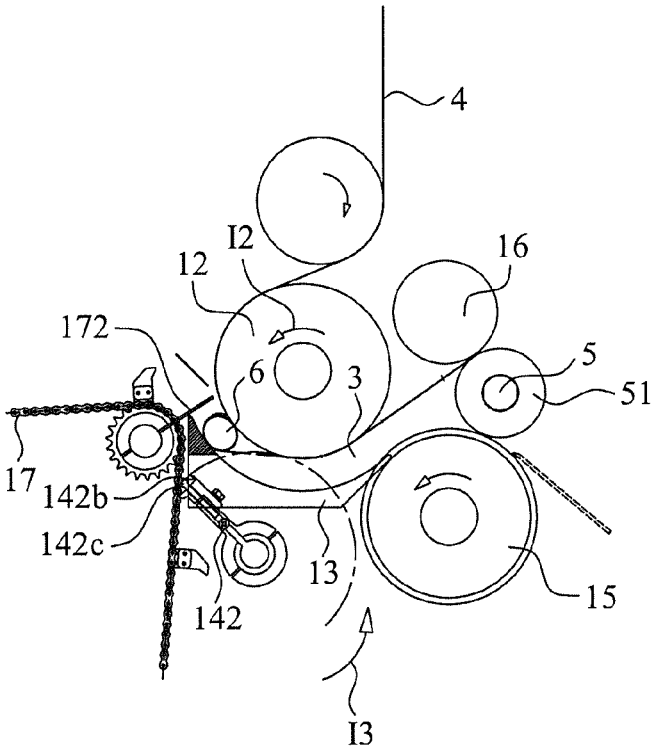
FIG. 18 is a schematic side view showing a sixth view of separating the web material by the winding machine according to the second embodiment of the present invention.
Figure 19:
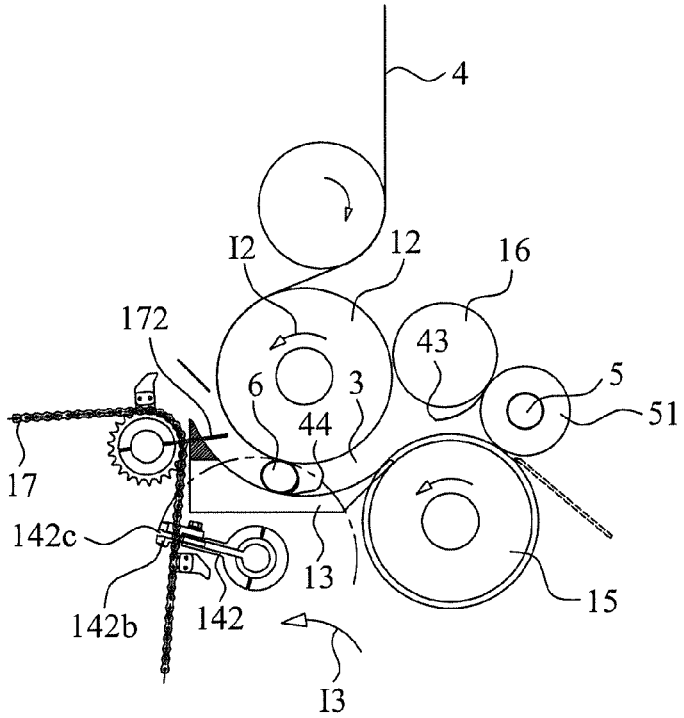
FIG. 19 is a schematic side view showing a seventh view of separating the web material by the winding machine according to the second embodiment of the present invention.

Referring to FIGS. 13-20, a sequence of operations of a winding machine in accordance with a second embodiment of the present invention are illustrated. FIGS. 13-15 illustrate the same operations as those shown in the first embodiment, but in FIG. 16, in the normal winding operation of the web material, the rotational speed of the lower winding roller 15 is slightly reduced and thus slowed down to have the web material 4 slackened inside the channel 3 and thus forming a slack portion 42. The slack portion 42 is guided by the web engagement end 142*b* of the pinch arm 142 (see FIG. 17) to have at least a portion thereof (that is adjacent to the second core 6) clamped between the second core 6 and the guide plates 13 (see FIG. 18). At this point, the lower winding roller 15 resumes the original rotational speed and a pulling force is applied from the paper roll 51 formed in the winding nip 19 to the web material 4 to tear the web material 4 (see FIG. 19). The location where the tearing of the web material 4 occurs is between the location where the web material 4 is clamped between the second core 6 and the guide plates 13 and the paper roll 51 of the first core 5.

Similar to the previous embodiment, when the pinch arm 142 is driven to rotate in the rotation direction 13 to bring the web engagement end 142*b* of the pinch arm 142 to periodically reach the engagement position A where the web engagement end 142*b* opposes the upper winding roller 12, the suction opening 142*c* of the web engagement end 142*b* of the pinch arm 142 generates a suction force, which helps the web engagement end 142*b* of the pinch arm 142 to clamp at least a portion of the slack portion 42 of the web material 4 between the second core 6 and the guide plates 13.

Figure 20:
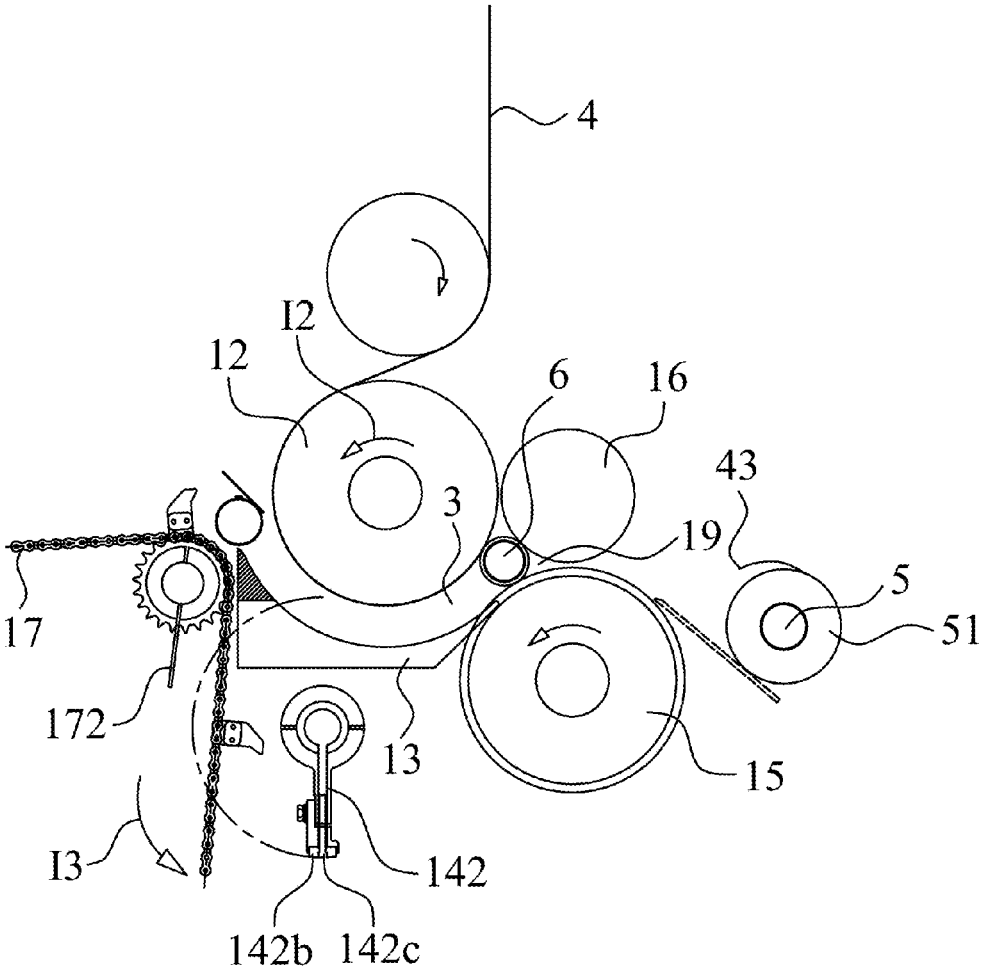
FIG. 20 is a schematic side view showing an eighth view of separating the web material by the winding machine according to the second embodiment of the present invention.

When the web material 4 is torn, the subsequent operations (as shown in FIG. 20) are identical to those of the previous embodiment.

Although the present invention has been described with reference to the preferred embodiments thereof and the best modes for carrying out the present invention, it is apparent to those skilled in the art that a variety of modifications and changes may be made without departing from the scope of the present invention which is intended to be defined by the appended claims.

What is claimed is:

1. A method for separating a web material in a winding machine comprising an upper winding roller, at least one guide plate, a lower winding roller, and a rider roller, wherein the guide plate is arranged at a location close to and below the upper winding roller and forms a channel with the upper winding roller, the upper winding roller, the lower winding roller, and the rider roller forming therebetween a winding nip, a separation mechanism being arranged below the upper winding roller and comprising a pivot shaft and a pinch arm extending from the pivot shaft, the pinch arm having a web engagement end forming at least one suction opening, the method comprising the following operations:

(a) having a web material borne on a lower circumferential surface of the upper winding roller rotatable in a predetermined rotation direction to feed the web material into and through the channel;

(b) winding the web material passing through the channel around a first core in the winding nip to form a paper roll;

(c) rotating the pinch arm, the web engagement end thereby periodically reaching an engagement position where the web engagement end opposes the upper winding roller, the web engagement end of the pinch arm engaging the web material at the engagement position without bearing against the upper winding roller, the web engagement end at the engagement position maintaining a predetermined spacing from the upper winding roller, such that the pinch arm does not contact the upper winding roller;

(d) causing the suction opening to suck and hold the web material disposed in the channel against the web engagement end at the time the web engagement end of the pinch arm is at the engagement position; and (e) subjecting the web material to a pulling force induced by the paper roll formed in the winding nip to tear and separate the web material at a location between the engagement position and a position of the paper roll of the first core;

wherein the pinch arm is rotatable in a direction opposite to the predetermined rotation direction of the upper winding roller; and, operation (c) further comprises a sub-step of reducing rotational speed of the lower winding roller to have the web material slightly slackened.

2. The method for separating the web material in a winding machine as claimed in claim 1, wherein in operation (a), before the web material is fed into the channel, the web material is subjected to perforation to form lines of perforations at a fixed interval.

3. A structure for separating a web material in a winding machine comprising an upper winding roller, at least one guide plate, a lower winding roller, and a rider roller, wherein the guide plate is arranged at a location close to and below the upper winding roller and forms a channel with the upper winding roller, the upper winding roller, the lower winding roller, and the rider roller forming therebetween a winding nip, a web material being fed into and passing through the channel to form a paper roll in the winding nip by being wound around a first core, a separation mechanism being arranged at a location close to and below the upper winding roller, the separation mechanism comprising:

a pivot shaft having an outer circumferential surface;

at least one pinch arm coupled to the outer circumferential surface of the pivot shaft, the pinch arm having a connecting end and a web engagement end, the connecting end being fixedly mounted to the outer circumferential surface of the pivot shaft, the web engagement end extending outward from the outer circumferential surface of the pivot shaft and forming at least one suction opening;

a driving mechanism connected to the pivot shaft to drive the pinch arm to rotate about the pivot shaft to position the web engagement end of the pinch arm periodically at an engagement position opposing the upper winding roller, the web engagement end of the pinch arm at the engagement position engaging the web material without bearing against the upper winding roller, the web engagement end at the engagement position maintaining a predetermined spacing from the upper winding roller, such that the pinch arm does not contact the upper winding roller;

a suction channel formed inside the pivot shaft and communicating with the suction opening of the web engagement end through a passage; and an evacuation device connected to the pivot shaft and communicating with the suction channel to form a vacuum suction force at the suction opening of the web engagement end of the pinch arm;

wherein when the pinch arm is driven by the driving mechanism to position the web engagement end of the pinch arm at the engagement position, the suction opening of the web engagement end of the pinch arm sucks and holds the web material disposed in the channel against the web engagement end, whereby the web material is subjected to a pulling force induced by the paper roll formed in the winding nip to tear and separate at a location between the engagement position and a position of the paper roll of the first core; and, wherein the pinch arm is rotatable in a direction opposite to the predetermined rotation direction of the upper winding roller.

4. The structure for separating the web material in a winding machine as claimed in claim 3 further comprising a perforation device arranged at a location close to the channel to form lines of perforations at a fixed interval in the web material before the web material is fed into the channel.

* * * * *